US006134836A

United States Patent [19]

Kawanobe et al.

[11] Patent Number: 6,134,836

[45] Date of Patent: Oct. 24, 2000

[54] DEVICE FOR AUTOMATICALLY CONTROLLING THE CLOSURE OF A SLIDING DOOR FOR A VEHICLE

[75] Inventors: Osamu Kawanobe; Ryoji Shimura, both of Yokohama, Japan

[73] Assignee: Ohi Seisakusho Co., Ltd., Yokohama, Japan

[21] Appl. No.: 08/911,035

[22] Filed: Aug. 14, 1997

[30] Foreign Application Priority Data

Aug. 19, 1996 [JP] Japan ..... 8-234669

[51] Int. Cl.[7] ..... E05F 11/00

[52] U.S. Cl. ..... 49/360; 340/825.69

[58] Field of Search ..... 49/32, 360; 318/282; 340/825.69

[56] References Cited

U.S. PATENT DOCUMENTS 4,916,861 4/1990 Schap ..... 49/360
5,140,316 8/1992 DeLand et al. ..... 340/825.69
5,350,986 9/1994 Long et al. ..... 328/432
5,396,158 3/1995 Long et al. ..... 318/282
5,434,487 7/1995 Long et al. ..... 49/32
5,684,470 11/1997 DeLand et al. ..... 340/825.69

*Primary Examiner*—Daniel P. Stodola
*Assistant Examiner*—Curtis A. Cohen
*Attorney, Agent, or Firm*—Foley & Lardner

[57] ABSTRACT

A device for automatically controlling the open-close of a vehicular sliding door enabling to smoothly change the slide door open-close control system from a manual to an automatic with decreasing any shock generated in changing the mode. Having a drive source (54), such as motor and the like, a slide door (3) able to open and close by the manual or the slide door open-close mechanism, a clutch (56) for conveying intermittently drive force of the drive source to the slide door open-close mechanism, a door speed detector (78), and a slide door controller (7) for controlling the drive source and the clutch in order to adjust the drive force transferred to the slide door open-close mechanism. When the slide door is detected that it is moving at a speed higher than a manual recognition speed, the drive source and the slide door open-close mechanism are connected at a half-clutched condition and then they are connected at a full-clutched condition.

9 Claims, 11 Drawing Sheets

[Fig.1]
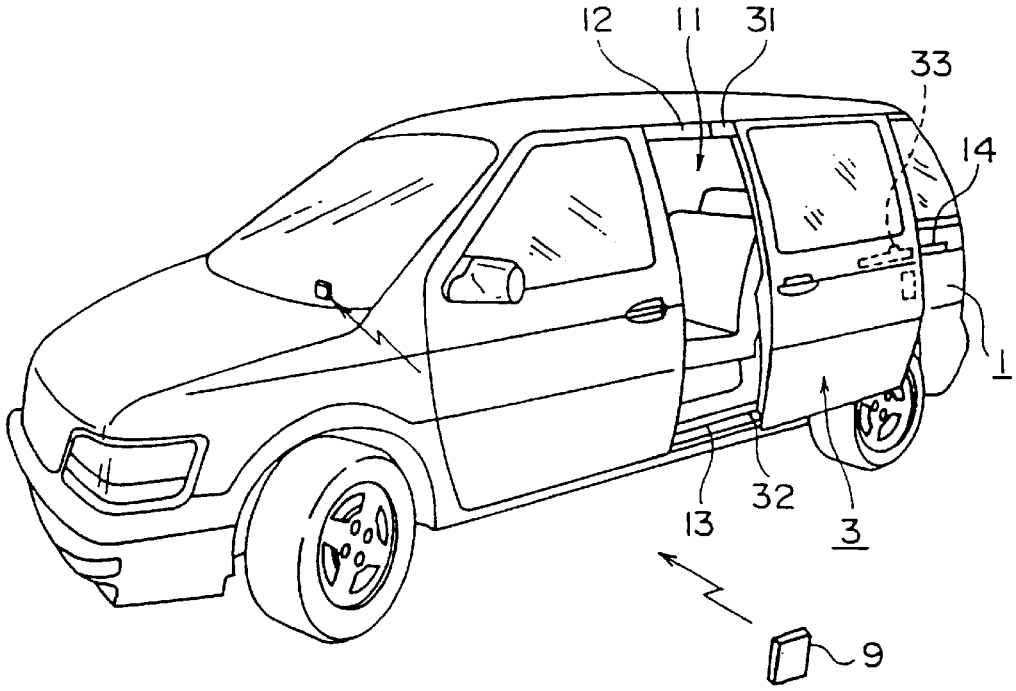

[Fig.2]
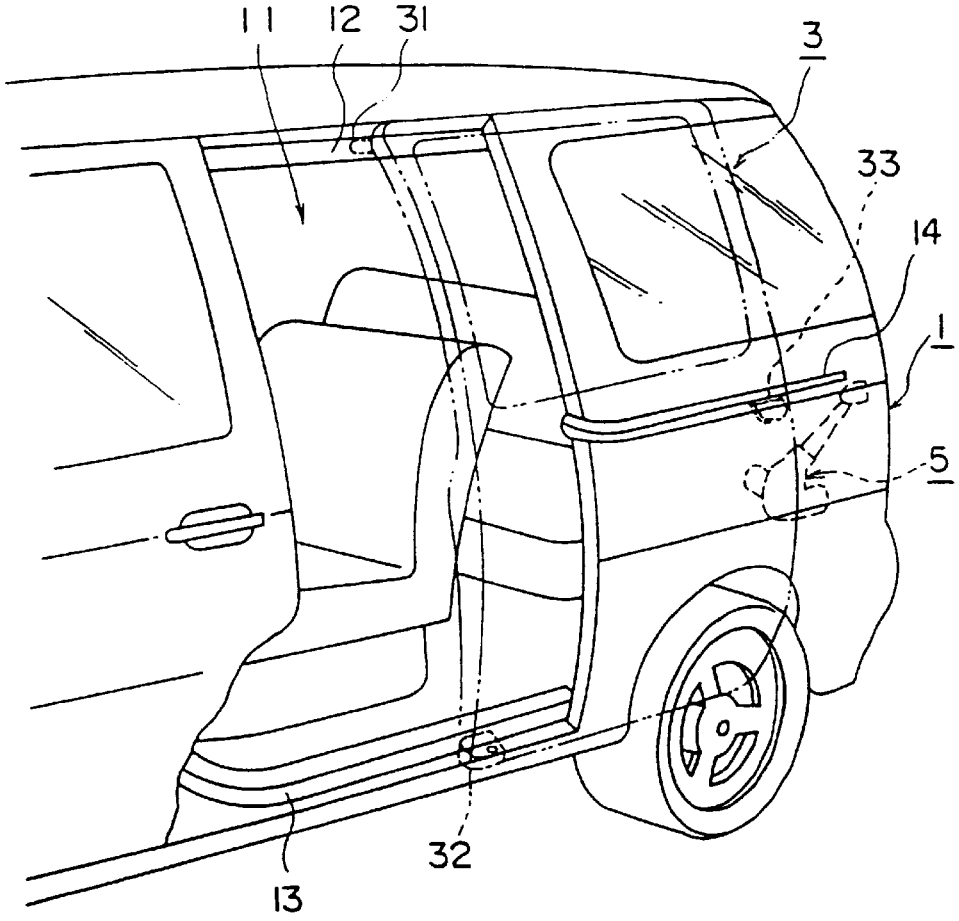

[Fig.3]
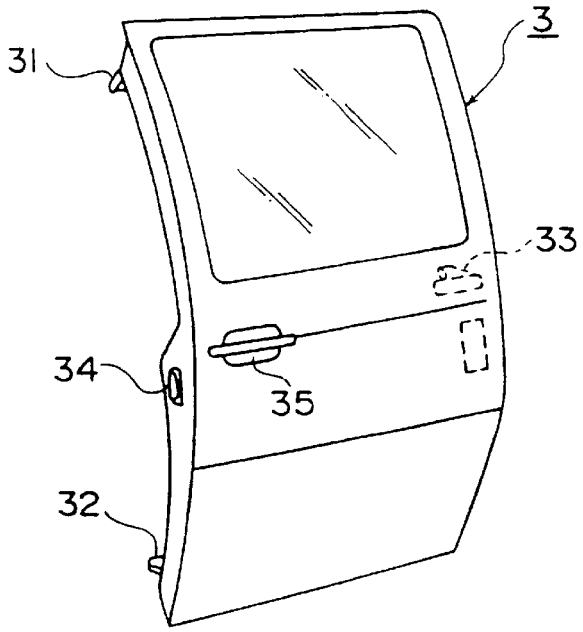
[Fig.4]
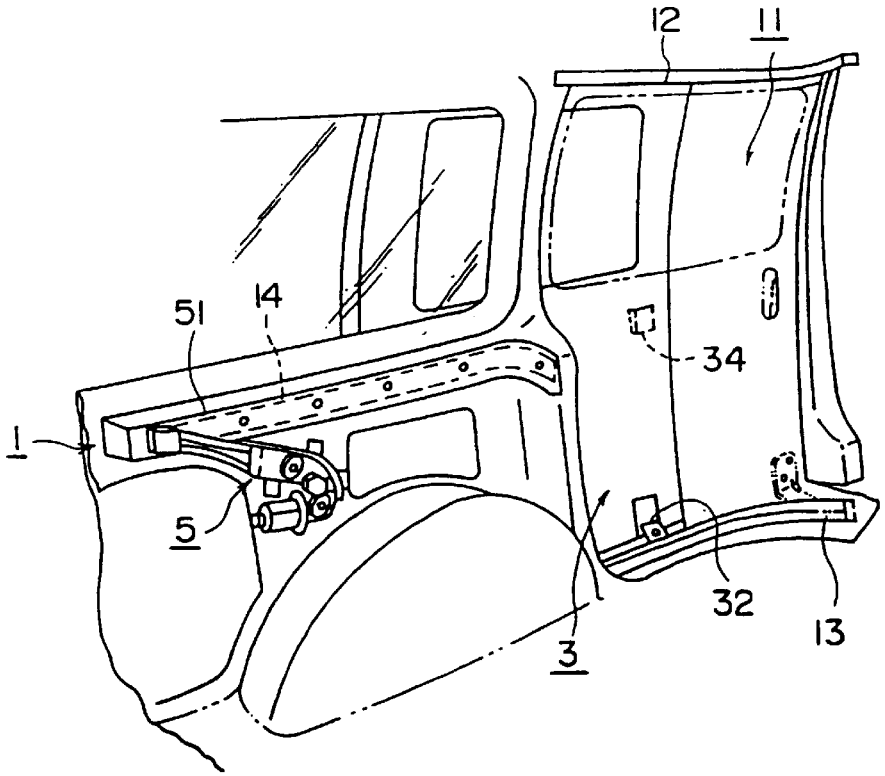

[Fig. 5]
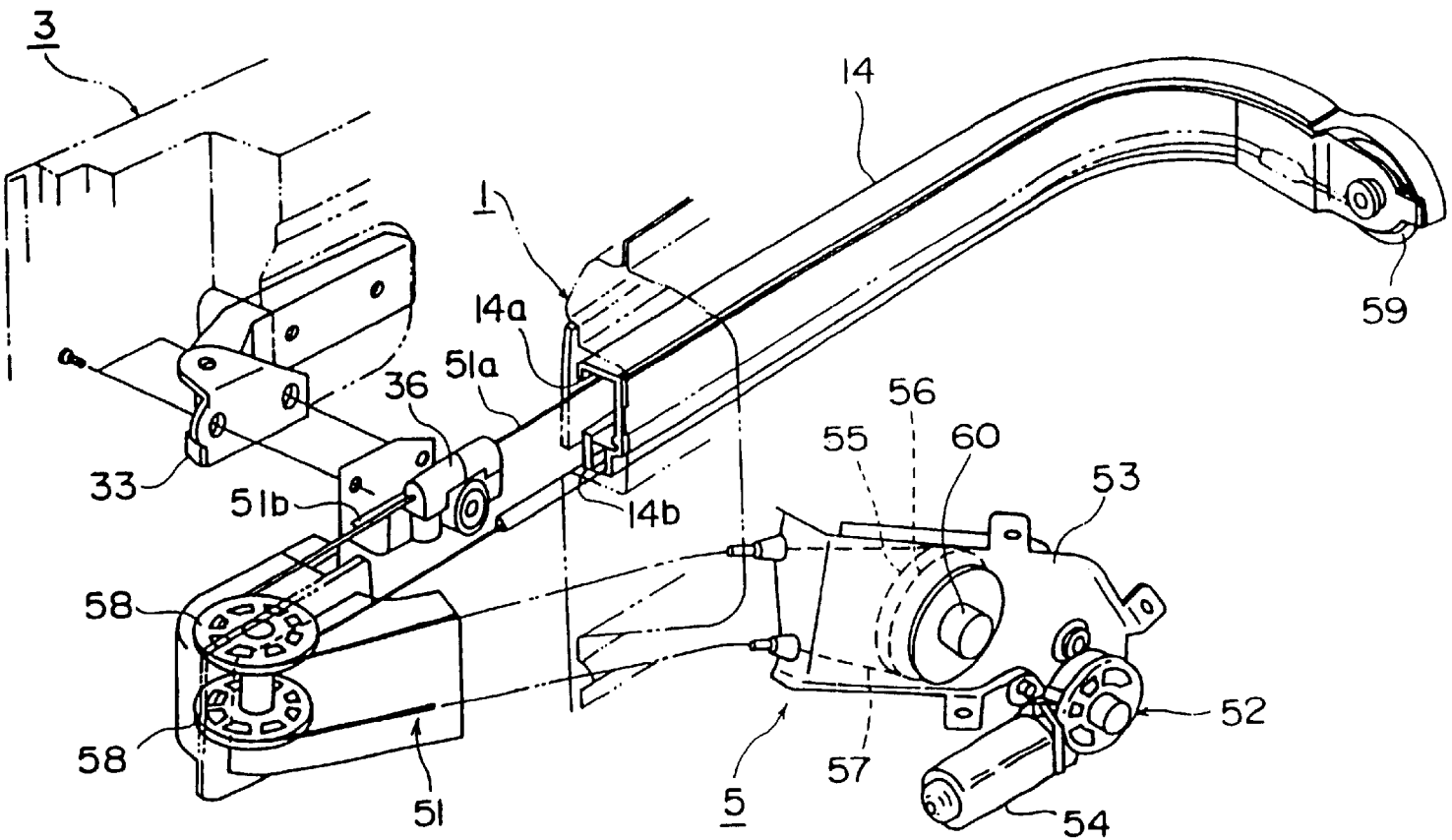

[Fig. 6]
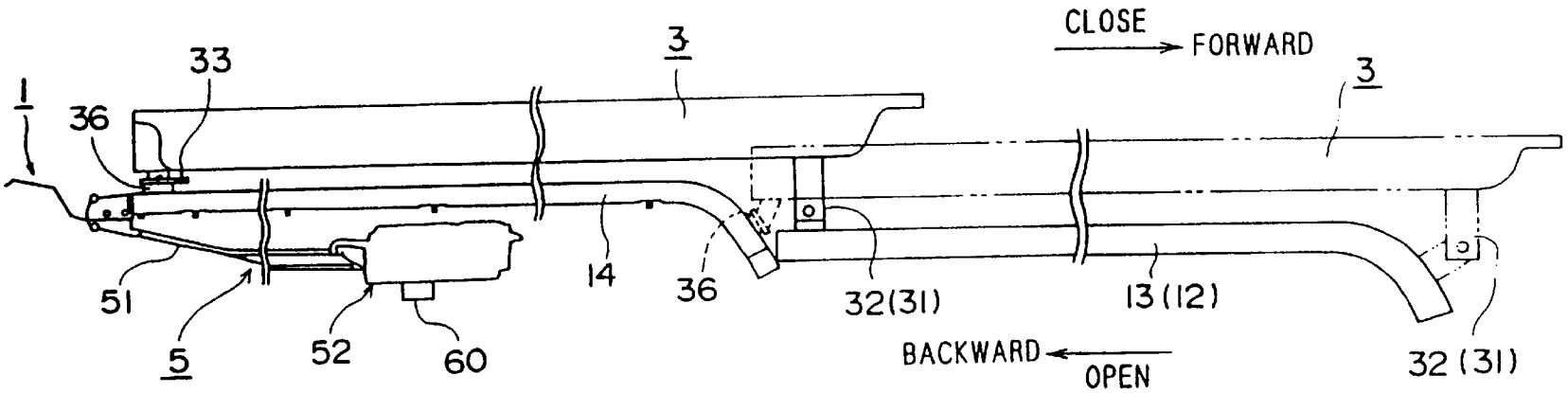

[Fig. 7]
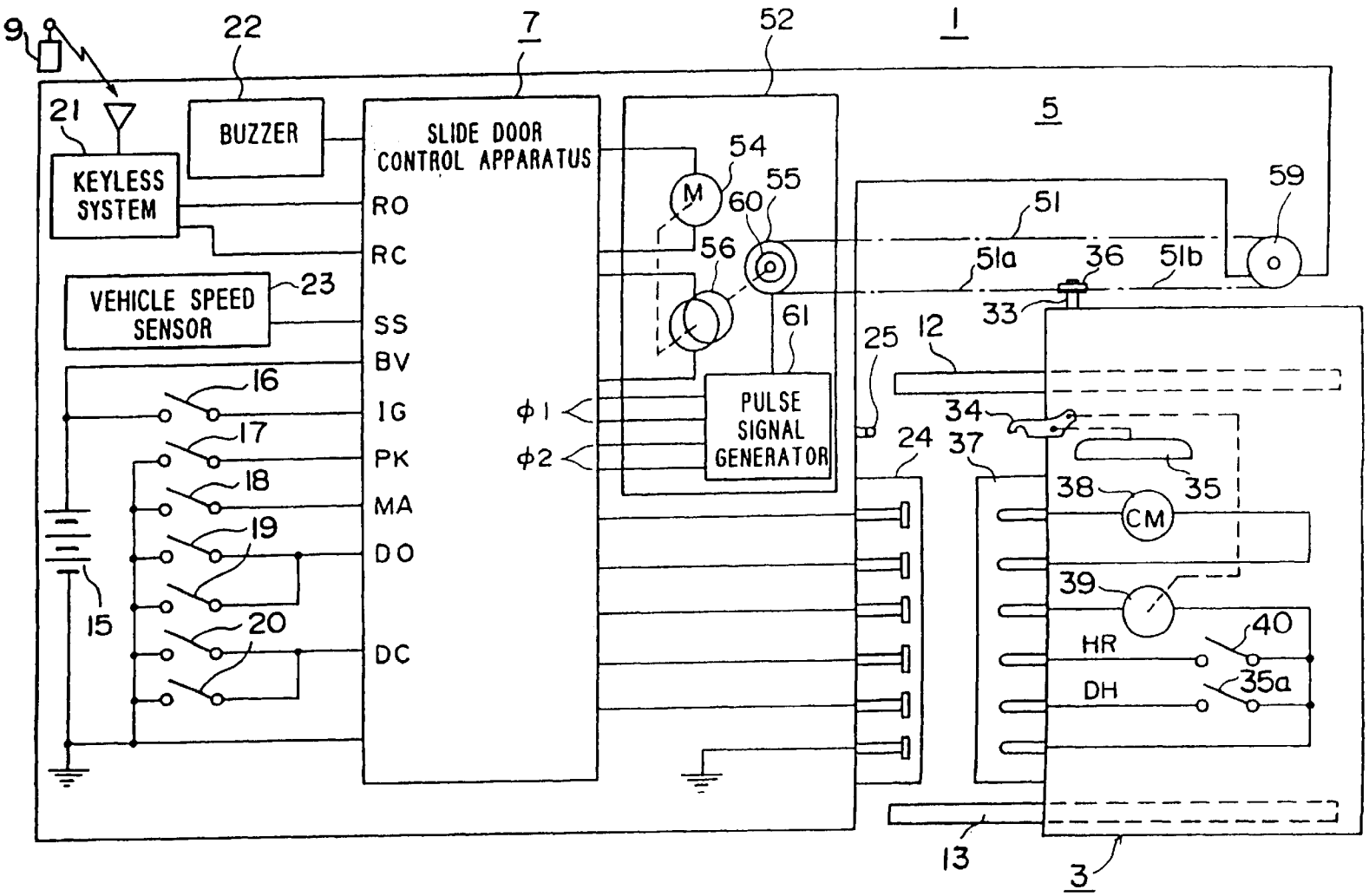

[Fig. 8]
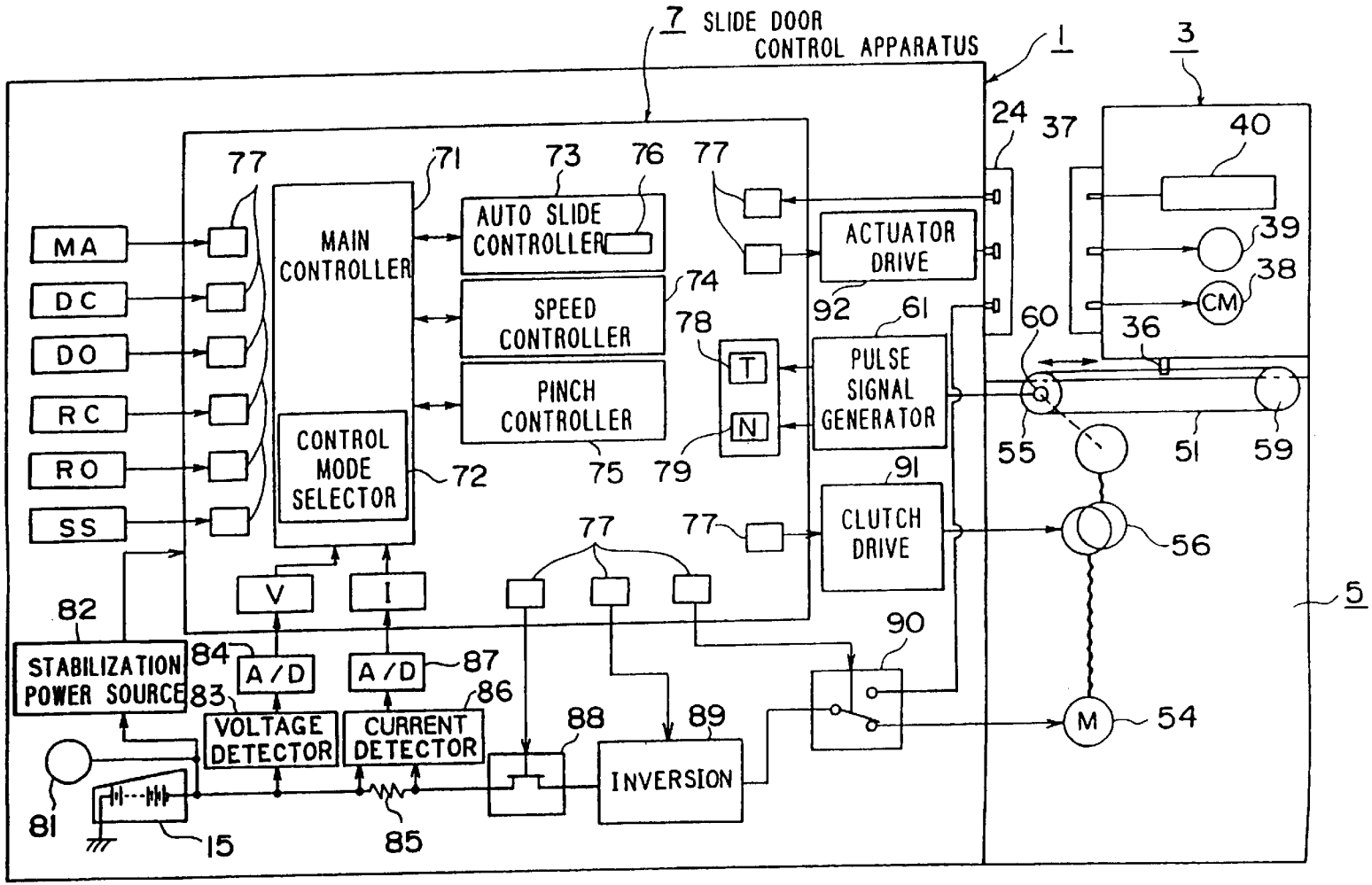

[Fig. 9]
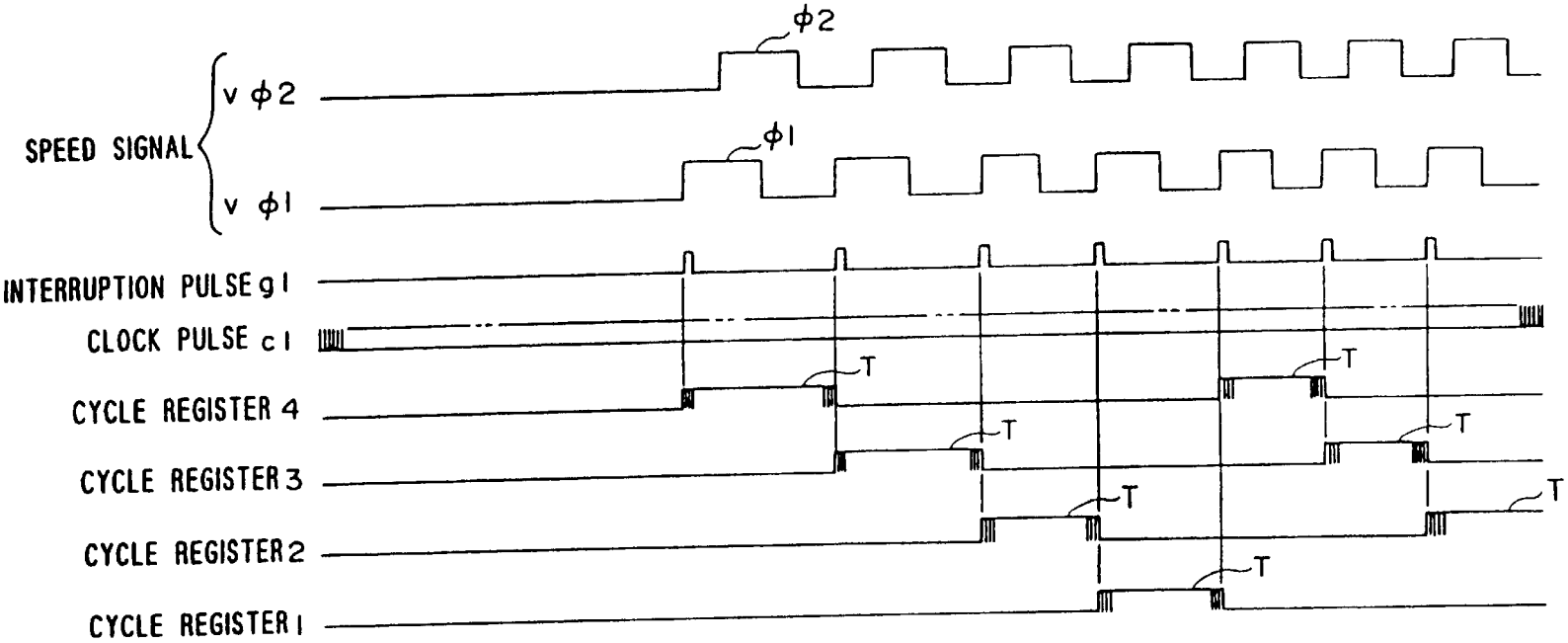

[Fig.10]
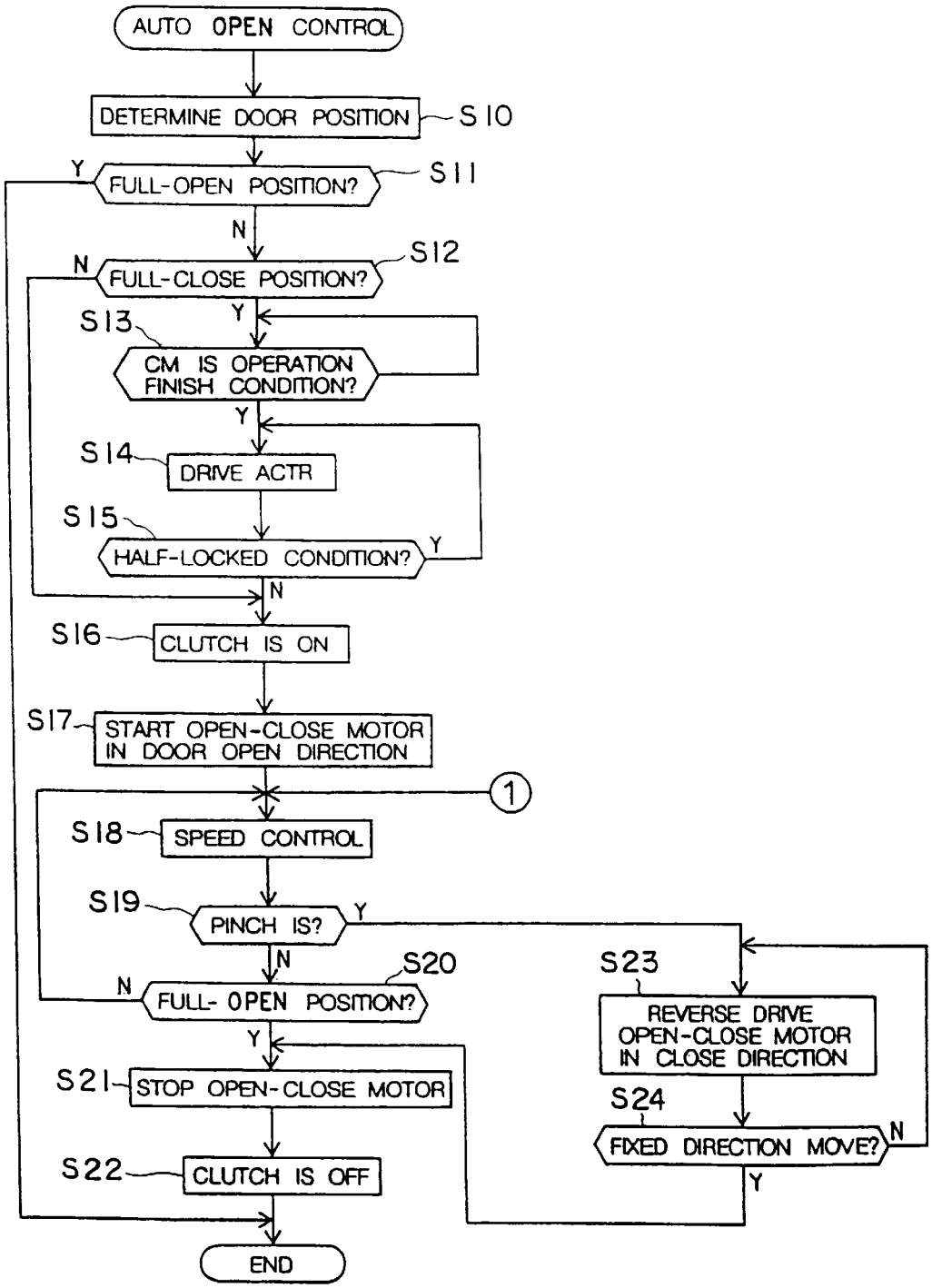

[Fig.11]
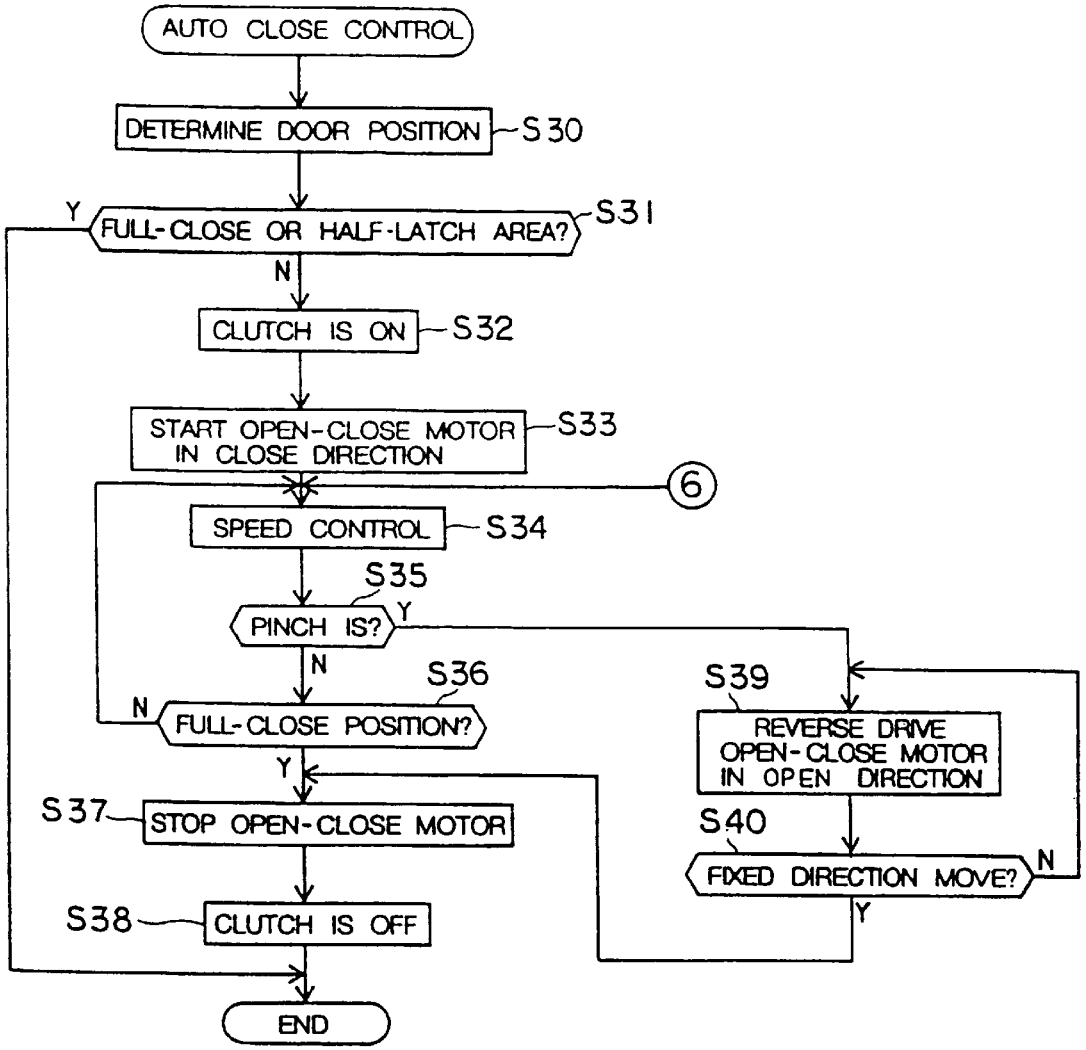

[Fig.12]
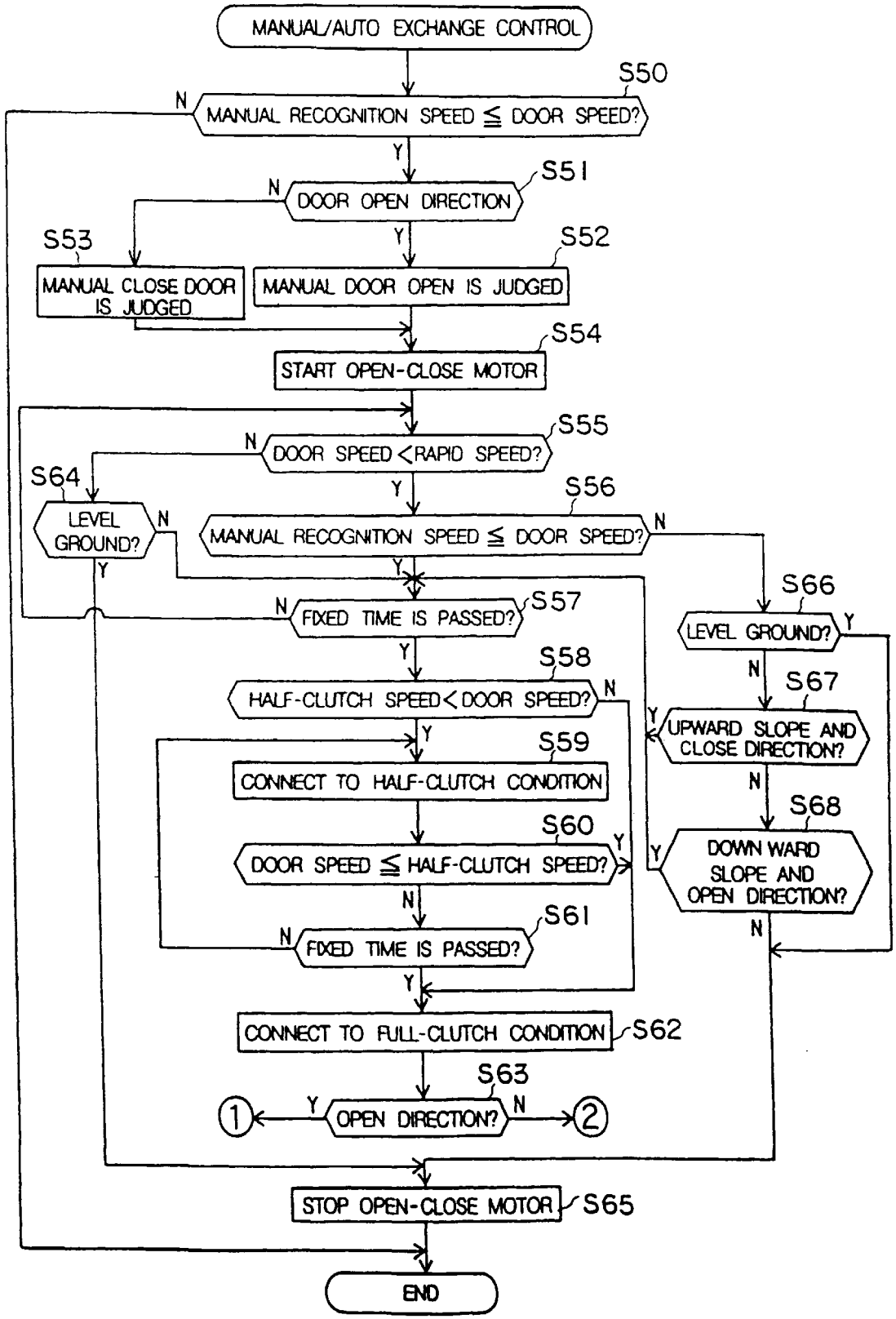

DEVICE FOR AUTOMATICALLY CONTROLLING THE CLOSURE OF A SLIDING DOOR FOR A VEHICLE

BACKGROUND OF THE INVENTION

1. Field of the Invention

This invention relates to an device for automatically controlling the open-close of a vehicular sliding door adapted to be able to automatically open and close the slide door installed on a side of a vehicle body such as an automobile one by means of a drive source such as a motor and the like. In particular, the device can be adapted to be changed from a manual to an auto.

2. Description of the Related Art

Conventionally, it has been known of an device for automatically controlling the open-close of a vehicular sliding door to open and close the slide door by means of the drive source such as a motor and the like, wherein the slide door is supported on a side of the vehicle body so as to slide along a front-back direction. According to the conventional device, a user of this device intentionally operates an operating means placed at a driver seat or near the door lever in order to start the drive source opening or closing the slide door.

According to another conventional technology, when this device detecting that the slide door moved a predetermined distance manually, the drive source is started in order to open and close automatically the slide door in place of a manual.

This conventional device controls the slide door to open and close automatically by being changed from a manual operation to an automatic operation. When the moving speed of the slide door doesn't match with the rotary speed of the motor in this above-mentioned automatically controlling operation by being changed from the manual to the automatic, a shock is generated due to the speed difference when being changed from the manual operation to the automatic. Therefore, by this shock, an user feels unpleasant and inconvenient. In order to solve such problem, the clutch is engaged after idlingly driving the motor in a fixed time period and matching the moving speed with the rotary speed, and the drive force of the motor is transferred to the slide door moving open-close directions.

However, such conventional technology fails to attain high effect when the moving speed of the slide door is high and resultantly a shock due to change of the mode from manual to automatic doesn't decrease giving the user unpleasant feeling. It is inconvenient.

SUMMARY OF THE INVENTION

This invention has been invented in order to solve such problem of the conventional technology and its purpose is to provide a device for automatically controlling the open-close of a vehicular sliding door enabling to smoothly change the slide door open-close control system from a manual to an automatic with decreasing any shock generated in changing the mode.

The invention described in claim 1 has a device for automatically controlling the open-close of a vehicular sliding door having a drive source such as a motor and the like; a slide door adapted to be open-close movable by means of a manual or a slide door open-close mechanism so supported as to be able to open and close along a side of the vehicular body; a clutch means for intermittently transferring a drive force of the drive source to the slide door open-close mechanism; a door speed detection means for measuring a moving speed of the slide door; and a slide door control means for controlling the drive source and the clutch means in order to control the drive force to be transferred to the slide door open-close mechanism. In the invention of claim 1, the slide door control means, when the door speed detection means detects that the slide door is moving at a speed higher than a manual recognition speed, starts the drive source and controls the clutch means in order to connect the drive source and the slide door open-close mechanism in a half-clutched condition, and then connect them in a full-clutched condition.

The invention described in claim 2 has the above-mentioned construction described in claim 1, wherein the slide door control means controls the clutch means to connect them in a half-clutched condition and to connect them in a full-clutched condition after passing a fixed time period.

The invention described in claim 3 has the above-mentioned construction described in claim 1, wherein the slide door control means controls the clutch means to connect them in a half-clutched condition and, when a door speed detection means detecting that a moving speed of the slide door has become lower than a predetermined speed, to connect them in a full-clutched condition.

The invention described in claim 4 has the above-mentioned construction described in claim 1, wherein the slide door control means controls the clutch means to connect them in a half-clutched condition and controls the clutch means to shift to a full-clutched condition with gradual increasing a clutch engagement degree.

The invention described in claim 5 is one described in anyone of claims 1 to 4, wherein the slide door control means controls the clutch means to connect them in a half-clutched condition with the clutch engagement degree according to the moving speed of the slide door.

The invention described in claim 6 has the above-mentioned construction described in claim 1, further comprising a slope judgement means for detecting the vehicle body posture, wherein the slide door control means detects the vehicle body posture by the slope judgement means when the door speed detection means detects that the slide door is moving in a speed higher than the manual recognition speed, and shortens a detection period by the door speed detection means when the slope judgement means detecting that the vehicle body is slanted.

The invention described in claim 7 has the above-mentioned construction described in claim 1, further comprising a slope judgement means for detecting the vehicle body posture, wherein the slide door control means detects that the slide door is moving in a speed lower than the manual recognition speed after the slide door control means having started driving the drive source, and controls the slope judgement means to detect the posture of the vehicle body, detects that the slide door is moving along a direction opposite to the slanting direction of the vehicle body, controls the clutch means in order to connect the drive source to the slide door open-close mechanism in a half-clutched condition, then controls the clutch means to connect them in a full-clutched condition.

According to this invention, when the slide door moves at a speed higher than a manual recognition speed and the slide door open-close mode changes from a manual to an automatic one, the slide door control means controls the drive source and the clutch means in order to connect the drive source to the slide door open-close mechanism in a half-clutched condition and then to connect the drive source to the slide door open-close mechanism in a full-clutched condition. As a result, the door moving speed and the motor rotary speed are tried to match each other during such half-clutched condition, this invention make a shock due to change of the mode from a manual to an automatic decrease and enables to make the change of the mode smooth.

Also, when the vehicle body slants on a slope, a detection time for the slide door manual recognition speed is shorten and a priority is given to a rapid or timely care of speed change than recognition precision. Detection sensibility of the slide door manual recognition speed is controlled as shown below. When the slide door is operated along its closing direction on an upward slope or along its opening direction on a downward slope, it is supposed that the door is operated against its weight and the slide door open-close control system is changed from a manual to an automatic one even the door moving speed is lower than the manual recognition speed.

BRIEF DESCRIPTION OF THE DRAWINGS

FIG. 1: Appearance perspective view of one example of vehicles to which the invention is applied.

FIG. 2: Enlarged perspective view of vehicle body showing a condition of the body with a slide door removed.

FIG. 3: Perspective view of the slide door.

FIG. 4: Perspective view showing a fixture portion of the slide door seeing a side of vehicle interior.

FIG. 5: Perspective view showing the important portion of the slide door drive apparatus.

FIG. 6: Schematic plane view showing the slide door transferred situation.

FIG. 7: Block diagram showing connection relation between the slide door control apparatus and the peripheral electric elements.

FIG. 8: Block diagram showing important portion of the slide door control apparatus.

FIG. 9: Time chart explaining operation of the speed calculation portion.

FIG. 10: Flow chart explaining operation of the automatic open control process.

FIG. 11: Flow chart explaining operation of the automatic close control process.

FIG. 12: Flow chart explaining operation of the manual/automatic exchange control process.

DETAILED DESCRIPTION OF THE PREFERRED EMBODIMENT

FIG. 1 is an appearance perspective view showing one example of the automobile to which a device for automatically controlling the open-close of a vehicular sliding door according to the invention is applied. A slide door 3 is shown in a condition of installation on a side of the vehicle body 1 so as to open and close along its front and back direction. FIG. 2 is an enlarged perspective view of the vehicle body 1 with the slide door 3 (shown by dotted lines) removed. FIG. 3 is a perspective view showing only the slide door 3.

As shown in these figures, the slide door 3 is hung on the vehicle body 1 so as to slide along front-back direction of the automobile by making an upper slide connector 31 and a lower slide connector 32 respectively fixed on an inner upper end and an inner lower end engaged with an upper track 12 installed on upper edge of the door opening portion 11 of the vehicle body 1 and a lower track 13 installed on lower edge of the door opening portion 11.

Further, the slide door 3 is installed so that a hinge arm 33 attached to an inside rear end slidably engages with a guide track 14 fixed near a rear waist portion of the vehicle body 1 and so it is guided, the slide door moves backwardly in parallel with an outside panel side face of the vehicle body 1 with the door protruding a little from an outside face of an outer panel of the vehicle body 1 from its full-close position sealing the door opening portion 11 to its full-open position fully opening the door opening portion 11.

Furthermore, the slide door 3 is structured to be held at its full-close position of firm sealing condition by engaging the door lock 34 installed on end face of the opening with a striker fixed at a side of the vehicle body 1 when the slide door 3 places at its full-close position. A door lever 35 for carrying out a manual open-close operation is fixed on outer side face of the slide door 3.

As shown in FIG. 4, a slide door drive apparatus 5 is installed at a rear of the door opening portion 11 of the vehicle body 1 between the outer panel covering the vehicle body 1 and the inner panel of the vehicle interior. The slide door drive apparatus 5 moves a cable member 51 arranged in the guide track 14 by a motor driving operation and thus makes the slide door 3 connected to the cable member 51 moves.

It is noted that this embodiment is instructed to control the open-close of the slide door 3 by operating an open-close switch (not shown) placed in the body interior, as well as it is possible to be instructed to control the open-close of the door 3 by such orders from the outside of the vehicle body 1 by a wireless remote controller 9 as shown in FIG. 1.

FIG. 5 is a perspective view showing important portion of the slide door drive apparatus 5. The slide door drive apparatus 5 has a motor drive portion 52. This motor drive portion 52 is structured by a base plate 53 fixed at a side of the vehicle body interior by bolts and the like. And a reversible open-close motor 54 for opening and closing the slide door 3, a drive pulley 55 around which the cable member 51 winds, and a speed reduction portion 57 including the electromagnetic clutch 56 respectively are fixed to the base plate 53.

The drive pulley 55 has an irreversible speed reduction mechanism outputting irreversible rotation transmission force, reducing a rotation number of the open-close motor 54 and increasing an output torque. The increased torque is transferred to the cable member 51. Also, the electromagnetic clutch 56 is differently and timely magnetized when the open-close motor 54 is driven, resulting in a mechanical connection between the open-close motor 54 and the drive pulley 55.

The cable member 51 wound around the drive pulley 55 forms an endless cable by running in parallel to each other around an upper open portion 14*a* of the guide track 14 open outwardly and a lower open portion 14*b* through a pair of guide pulleys 58 and 58 each installed near the guide track 14, and further around a reverse pulley 59 installed at a front end of guide track 14.

At a suitable portion of the cable member 51 running on an open portion 14*a* of the guide track 14, there is a moving member 36 fixed so as to run smoothly through an open portion 14*a*. A front portion of cable member 51 is a door closing cable 5l*a* and its rear portion is a door opening cable 51*b* divided from the moving member 36.

The moving member 36 is connected to an inner rear end portion of the slide door 3 through the hinge arm 33. The moving member 36 moves along forward and backward directions in the open portion 14*a* by means of pulling force of the door opening cable 51*a* or the door closing cable 51*b* due to the rotation of the open-close motor 54. Accordingly, the slide door 3 moves in the door closing direction or the door opening direction.

A rotary encoder 60 for measuring a rotary angle of the drive pulley 55 at a high resolution is connected to a rotary shaft of the drive pulley 55. The rotary encoder 60 generates output signal of pulse number according to the rotary angle of the drive pulley 55 in order to measure a moved distance of the cable member 51 wound around the drive pulley 55 or a moved distance of the slide door 3.

As a result, a measured or counted value N of the pulse number from the rotary encoder 60 with its initial value of the full-close position of the slide door 3 to its full-open position depicts a position of the moving member 36 or a position of the slide door 3.

FIG. 6 is a schematic plan view showing a movement situation of the slide door 3. As described above, a front portion of the slide door 3 is held by upper side connector 31 and lower slide connector 32 respectively engaged with an upper track 12 and a lower track 13. A rear portion is held by the hinge arm 33 fixed to the cable member 51 through the moving member 36.

Slide Door Control Apparatus

Next, a connection relation of the slide door control apparatus 7 and various electric elements in the vehicle body 1 and the slide door 3 will be explained with reference to a block diagram shown in FIG. 7. The slide door control apparatus 7 has a micro-computer and its programs and controls the slide door drive apparatus 5, and is placed for example near the motor drive portion 52 in vehicle body 1.

Connections between the slide door control apparatus 7 and various electric elements in the vehicle body 1 are shown below; connections of a battery 15 for receiving a DC voltage BV, of an ignition switch 16 for receiving an ignition signal IG, of a parking switch 17 for receiving a parking signal PK, and of a main switch 18 for receiving a main signal MA.

Furthermore, there are other connections of the door open switch 19 for receiving a door open signal DO, of a door close switch 20 for receiving a door close signal DC, of a keyless system 21 for receiving a remote-control open signal RO or close signal RC from the wireless remote-controller 9, of a buzzer 22 for generating alarm sound announcing that the slide door 3 will be automatically moved, and a vehicle speed sensor 23 for receiving a vehicle speed signal ss.

It is noted that the door open switch 19 and the door close switch 20 respectively have two operating means and they are arranged for example on a driver seat and a rear seat in the vehicle interior.

Next, with reference to connecting between the slide door control apparatus 7 and the slide door drive apparatus 5, there are connections for supplying power to the open-close motor 54, for controlling the electromagnetic clutch 56, and the pulse signal generator 61 for receiving the pulse signals of the rotary encoder 60 and generating a pulse signal $\phi 1$, $\phi 2$.

Additionally, there is another connection between the slide door control apparatus 7 and various electric elements in the slide door 3 and such connection can be attained by a connection between the vehicle body side connector 24 installed at the door opening portion 11 when the slide door 3 opens a little more than its full-close condition, and the door side connector 37 installed at the open end of the slide door 3.

There are connections between various electric elements in the slide door 3 and the slide door control apparatus 7 in such connected condition above, such as one for supplying a power to a closure motor (CM) 38 in order to tighten the slide door 3 at its position just before a half-clutched condition until a full-clutched condition, one for supplying a power to an actuator(ACTR) 39 in order to release the door lock 34 from the striker 25 by driving the door lock 34, one for receiving half-clutch switch 40 detecting half-clutched conditions and one for receiving the door lever signals DH from the door lever switch 35*a* detecting operation of the door lever 35 connected with the door lock 34.

Next, structure of the slide door control apparatus 7 will be explained with reference to a block diagram shown in FIG. 8. The slide door control apparatus 7 has a main control portion 71 for repeatedly carrying out control operations with a fixed interval. The main control portion 71 includes a control mode selector 72 for selecting a suitable control mode according to a situation of peripheral circuits.

The control mode selector 72 selects exclusive controllers most suitable and necessary to control in accordance with the newest situation of peripheral circuits. These exclusive controllers are an auto-slide control portion 73 for controlling mainly open-close operations of the slide door 3, a speed control portion 74 for controlling the movement speed of the slide door 3, and a pinch control portion 75 for detecting whether something restricting the movement of the slide door driven is pinched or not along its movement direction.

The auto-slide control portion 73 includes a slope judgement portion 76 for detecting a posture of the vehicle body 1.

The slide door control apparatus 7 has a plurality of input/output ports 77 used to input and output ON/OFF signals of the various switches and operation/non-operation signals of the relays or clutches and the like.

A speed calculation portion 78 and a position detector 79 receive two-phase pulse signal $\phi 1$, $\phi 2$ output from the pulse signal generator 61, generating a periodic count value T and a position count value N. Here, the operation of the speed calculation portion 78 will be explained with reference to a time chart shown in FIG. 9.

As shown in FIG. 9, two-phase speed signals $V\phi 1$, $V\phi 2$ correspond to two-phase pulse signals $\phi 1$, $\phi 2$ output from the rotary encoder 60 and the rotary direction of the rotary encoder 60, or the movement direction of the slide door 3 is detected from phase relation of both signals. Concretely, when the pulse signal $\phi 2$ is at L level (as shown) at a rise of the pulse signal $\phi 1$, it is judged for example that it is the door open direction. When the pulse signal $\phi 2$ is at H level, it is judged that it is opposedly the door close direction.

The speed calculation portion 78 generates interruption pulse g1 at a rise of the speed signal $V\phi 1$. During a generation period of generating the interruption pulse g1, the pulse number of the clock pulse C1 having a period sufficiently smaller than the interruption pulse g1 is counted, and this count value is the periodic count value T. Consequently, the periodic count value T is obtained by converting a period of the pulse signal $\phi 1$ output from the rotary encoder 60.

According to the embodiment of the invention, the speed of the slide door 3 is recognized by using the periodic count value of continuous four periods of the speed signal $V\phi 1$, so the embodiment has four period registers 1 to 4 for storing the periodic count value of four periods. The position count value N is able to be obtained by counting the speed signal $V\phi 1$ or the interruption pulse g1.

Returning to FIG. 8, the battery 15 is charged by a generator 81 while a vehicle is running, its output voltage is kept at a predetermined one by a stabilization power source circuit 82 and the stable voltage is supplied to the slide door control apparatus 7.

The output voltage of the battery 15 is detected by a voltage detector 83, a voltage value detected is converted into a digital signal through an A/D converter 84 and it is input into the main controller 71 of the slide door control apparatus 7. The output voltage of the battery 15 is supplied to a shunt resistor 85 and the current value I flowing through the shunt resistor 85 is detected by a current detector 86. The current value I detected is converted into a digital signal through an A/D converter 87 and input into the main controller 71 of the slide door control apparatus 7.

The output voltage of the battery 15 also is supplied to a power switch element 88 through the shunt resistor 85. This power switch element 88 is ON/OFF controlled through the slide door control apparatus 7 in order to convert DC signal to pulse signal supplies this pulse signal to the open-close motor 54 or the closure motor 38. It is possible to freely control a duty ratio of pulse signals.

Pulse signals obtained through the power switch element 88 is supplied to the open-close motor 54 or the closure motor 38 through an inversion circuit 89 and a motor exchange circuit 90. The inversion circuit 89 is used to change the drive direction of the open-close motor 54 or the closure motor 38. This inversion circuit 89 forms a power supply circuit for the motor together with the power switch element 88.

The motor exchange circuit 90 selects one of the closure motor 38 and the open-close motor 54 for open-and-close driving the slide door 3 according to instructions from the main controller 71. Both the motors function to drive the slide door 3, don't drive at the same time and supply selectively the drive power to one.

Other than that above, the slide door control apparatus provides with a clutched drive circuit 91 for controlling the electromagnetic clutch 56 according to the instruction from the main controller 71 and an actuator drive circuit 92 for controlling the actuator 39 according to the instruction of the main controller 71, too.

Operation/Auto Open Control

Next, the open-close automatic control of the slide door 3 functioning in accordance with the slide door control apparatus 7 will be explained with reference to a flow chart shown in FIGS. 10 to 12. Furthermore, such open-close automatic control process operates only when main switch 18 is ON condition, the power voltage is supplying to various electric elements together with the slide door control apparatus 7, the parking switch 17 is ON-condition and the shift lever is placed at P(park) range, a stop condition of the vehicle has been detected by the vehicle speed sensor 23 and the door lock knob is released and the slide door 3 is in open-closable condition. If lacking only one of these conditions or situations mentioned above, only the manual open-close operation is possible and the open-close automatic control of the slide door control apparatus 7 is not carried out.

First, an automatic open control ordered by the door open switch 19 installed within the vehicle interior or the wireless remote controller 9 in order to move the slide door 3 to its full-open position will be explained with reference to a flow chart shown in FIG. 10.

This automatic open control starts when the slide door control apparatus 7 receives a door open signal DO by the door open switch 19 or a remote open signal RO by the wireless remote controller 9. First, the present position of the slide door 3 is determined by using the position count value N (step S10), and on the basis of the determined position, it is judged whether the slide door 3 is in full-open position or not (step S11). When it is judged that the slide door 3 is in full-open position, the automatic open control is not necessary, so this automatic open control process ends.

When it is judged that the slide door 3 is not in full-open position in step S11, it is judged whether the slide door 3 is in full-close position or at half-locked condition (step S12). When it is judged that the slide door 3 is in full-close position or at half-locked condition, it is judged whether the closure motor (CM) 38 is confirmed to be at its operation-finished condition or not (step S13). When it is judged that the closure motor 38 is confirmed to be in its operation-finished condition, the actuator (ACTR) 39 is driven in order to release the door lock 34 from the striker 25 (step S14). It is confirmed on the basis of the half-latched signal HR that the half switch 40 is at OFF condition, and it is judged whether the slide door 3 is at half-locked condition or not (step S15).

When it is judged that the slide door 3 is not in full-close position in step S12 or when it is judged that the slide door 3 is not at half-locked condition in step S15, the clutch drive circuit 91 is controlled to mechanically connect the open-close motor 54 to the drive pulley 55 by means of the electromagnetic clutch 56 (step S16). In this step S16 situation, the motor exchange circuit 90 is exchanged to the side of the open-close motor 54, the power switch element 88 and the inversion circuit 89 are controlled to start driving the open-close motor 54 along the door open direction (step S17).

Next, the speed control is carried out by controlling the power switch element 88 and the rotation number of the open-close motor 54 in order to move the slide door 3 in its open door direction with a suitable or moderate speed (step S18). It is judged whether something restricting the movement of the slide door 3 driven during this step S18 process is pinched or not (step S19). When it is judged that something restricting the movement of the slide door 3 is pinched, it is judged whether the slide door 3 reaches its full-open position or not (step S20). When it is judged that the slide door 3 reaches its full-open position, the power switch element 88 is controlled to stop driving the open-close motor 54 (step S21). The clutch drive circuit 91 is controlled to release the mechanical connection of the electromagnetic clutch 56 between the open-close motor 54 and the drive pulley 55 (step S22), ending this automatic open control process.

When it is judged that something restricting the movement of the slide door 3 is pinched in step S19, the inversion circuit 89 is controlled to start driving reversely the open-close motor 34 along the door close direction (step S23). After this step S23 process, it is judged whether the slide door 3 moved to the fixed (predetermined) distance or not (step S24). When it is judged that the slide door 3 moved to the fixed distance, the power switch element 88 is controlled to stop driving the open-close motor 54 (step S21). The clutch drive circuit 91 is controlled to release the mechanical connection of the electromagnetic clutch 56 between the open-close motor 54 and the drive pulley 55 (step S22), ending this automatic open control process.

A pinch detection in step S19 is done by, for example, judging a current value I flown through the open-close motor 54, and a relation between the speed signals $V\phi 1$, $V\phi 2$. That is, when the current value I detected in the current detection portion 86 is high; and although the current is being supplied to the open-close motor 54; the period of the speed signals Vϕ1, Vϕ2 make the drive pulley 55 stop or considerably reduce its rotation speed, it is judged that something restricting a movement of the slide door 3 is pinched.

A detection of the full-open position in step S20 is carried out by watching a position count value N of that the full-close position of the slide door 3 is an initial value. According to an alternate method, a limit switch may be installed at the full-open position of the slide door 3 and the full-open position is detected by switching the limit switch.

Auto Close Control

Next, an automatic close control ordered by the door close switch 20 installed within the vehicle interior or the wireless remote controller 9 in order to move the slide door 3 to its full-close position will be explained with reference to a flow chart shown in FIG. 11.

This automatic close control process starts when the slide door control apparatus 7 receives the door close signal DC ordered by the door close switch 20 and the remote control close signal RC ordered by the wireless remote controller 9. First, the position of the slide door 3 is determined by the position count value N (step S30). It is judged on the basis of the determined position whether the slide door 3 is in its full-close position (or in its half-latched area) or not (step S31). When it is judged that the slide door 3 is in its full-close or in its half-latched area, this automatic close control process is not necessary, this process ending.

When it is judged in step S31 that the slide door is not in its full-close position or in its half-latched area, the clutch drive circuit 91 is controlled to mechanically connect the open-close motor 54 to the drive pulley 55 by means of the electromagnetic clutch 56 (step S32). In this step S32 situation, the motor exchange circuit 90 is exchanged to the side of the open-close motor 54, the power switch element 88 and the inversion circuit 89 are controlled to start driving the open-close motor 54 along the door close direction (step S33).

Next, the speed control is carried out by controlling the power switch element 88 and the rotation number of the open-close motor 54 in order to move the slide door 3 in its close door direction with a suitable or moderate speed (step S34). It is judged whether something restricting the movement of the slide door 3 driven during this step S34 process is pinched or not (step S35). When it is judged that something restricting the movement of the slide door 3 is pinched, it is judged whether the slide door 3 reaches its full-close position or not (step S36). When it is judged that the slide door 3 reaches its full-close position, the power switch element 88 is controlled to stop driving the open-close motor 54 (step S37). The clutch drive circuit 91 is controlled to release the mechanical connection of the electromagnetic clutch 56 between the open-close motor 54 and the drive pulley 55 (step S38), ending this automatic close control process.

When it is judged that something restricting the movement of the slide door 3 is pinched in step S35, the inversion circuit 89 is controlled to start driving reversely the open-close motor 34 along the door open direction (step S39). After this step S39 process, it is judged whether the slide door 3 moved to the fixed (predetermined) distance or not (step S40). When it is judged that the slide door 3 moved to the fixed distance, the power switch element 88 is controlled to stop driving the open-close motor 54 (step S37). The clutch drive circuit 91 is controlled to release the mechanical connection of the electromagnetic clutch 56 between the open-close motor 54 and the drive pulley 55 (step S38), ending this automatic close control process.

Noteworthily, the pinch detection process in step S35 is identical with the pinch detection process in step S19. A position detection process of the slide door 3 in step S36 is done by watching a position count value N with a full-close position of the slide door 3 being an initial value.

Manual/Auto Exchange Control

Next, when the slide door control apparatus 7 detects that the slide door 3 moved by the manual operation, this manual operation is changed to the automatic open control or the automatic close control. It is called a manual/auto change control and it will be explained with reference to a flow chart shown in FIG. 12. This manual/automatic exchange control process starts when the slide door control apparatus 7 watches during a stop condition of the open-close motor 54, the periodic count value T and detects that the door speed becomes higher than a predetermined one.

First, it is judged that whether the periodic count value T for continuous four periods stored in the period registers 1 to 4 becomes less than a predetermined value or not, that is to say, whether respective door speeds in continuous four periods are higher or not than a predetermined manual recognition speed in order to prevent a recognition from carrying out in erroneous (step S50). When it is judged that the door speeds are slower than the manual recognition speeds, it is judged that its operation is not a manual door operation, ending the manual/automatic exchange control process.

When it is judged that the door speeds is higher than the manual recognition speeds, it is judged on the basis of knowing the phase difference between two-phase speed signals Vϕ1, Vϕ2 whether the slide door 3 is in door open direction or in door close direction (step S51). When it is judged that the slide door 3 is in door open direction, it is judged that its operation is a manual door open condition (step S52). When it is judged that the slide door 3 is in door close direction, it is judged that its operation is a manual door close condition (step S53).

Next, basing on the judgement result in step S52 or in step S53, the power switch element 88, the inversion circuit 89 and the motor exchange circuit 90 are controlled to start driving the open-close motor 54 along its door open direction or along its door close direction (step S54). The electromagnetic clutch 56 is at OFF condition yet, so that the open-close motor 54 idlingly rotates.

Next, it is judged whether the door speed of the manual operation is lower than a predetermined or previously set rapid speed or not (step S55). When it is judged that the door speed of the manual operation is lower than the rapid speed, it is judged whether the door speed is higher than the manual recognition speed or not (step S56). When it is judged that the door speed is higher than the manual recognition speed, these process of step S55 to S57 are repeated until a fixed time is passed (Step S57). This step S57 is done to recognize that the manual open-close operation of the slide door 3 is continuing.

After the fixed time is passed in step S57, it is judged whether the door speed is higher than the predetermined half-clutched speed or not (step S58). When it is judged that the door speed is higher than the half-clutched speed, the clutch drive circuit 91 is controlled to connect the open-close motor 54 to the drive pulley 55 at a half-clutched condition by means of the electromagnetic clutch 56 (step S59). As a result, the door speed gradually advances or becomes near the rotation speed of the open-close motor 54, and a shock which is generated when they are connected suddenly in full-clutched condition during the door speed being high, is able to decrease.

When it is judged that the door speed lowers less than the half-clutched speed after a fixed time is passed (steps S60, S61), the clutch drive circuit 91 is controlled to connect the open-close motor 54 to the drive pulley 55 at a full-clutched condition by means of the electromagnetic clutch (step S62). After this step S62, it is judged whether the slide door is in its door open direction or in its door close direction (step S63). This process in step S63 is identical with these of the automatic open control or the automatic close control operation. When it is judged that the slide door 3 is in its door open direction, these steps after step S18 (FIG. 10) are carried out. When it is judged that the slide door 3 is in its door close direction, these steps after step S34 (FIG. 11) are carried out (step S63).

When it is judged that the manual door speed is higher than the rapid speed in step S55, it is judged whether the vehicle stands on level ground or not (step S64). When it stands on level ground, the open-close motor 54 is stopped in order to put a priority on a manual rapid close operation or rapid open operation (step S65), ending this manual/automatic exchange control process. The slope judgement portion 76 judges whether it is on a level ground or a slope.

When the vehicle stops on a slope, steps after step S57 are done in order to prevent the slide door 3 from quickly sliding due to its weight, and it is transferred to an automatic control.

When it is judged that the manual door speed is slower than the manual recognition speed in step S56, it is judged whether the vehicle stands on a level ground or not (step S66). When it is judged that the vehicle stands on a level ground, it is judged that the manual operation of the operator stops, so the open-close motor 54 is stopped (step S65), ending this manual/automatic exchange control process.

In case that the vehicle parks on the upward slope and the slide door 3 is operated along its door close direction or on the downward slope and the slide door 3 is operated along its open direction (steps S67, S68), the door movement speed is judged that it decreases because the slide door 3 is operated against its weight and steps after step S57 are carried out. In cases other than the above-mentioned case, it is judged that the manual operation of the operator is stopped making the open-close motor 54 stop (step S65), ending this manual/automatic exchange control process.

Other Embodiment

According to the above-mentioned embodiment, when the moving speed of the slide door 3 becomes less than a predetermined speed (half-clutched speed) or when a fixed time is passed, the electromagnetic clutch 56 is controlled to connect the open-close motor 54 to the drive pulley 55 at its half-clutched condition and then to connect the open-close motor 54 to the drive pulley 55 at its full-clutched condition. However, it is also possible to increase gradually an engagement degree of them from its half-clutched condition and then to connect the open-close motor 54 to the drive pulley 55 at its full-clutched condition.

It is possible to connect them with an engagement degree of the open-close motor 54 and the drive pulley 55 according to the moving speed of the slide door 3 when connecting the open-close motor 54 to the drive pulley 55. In such case, it is possible to shorten a transferring time from its half-clutched condition to its full-clutched condition.

According to the previous embodiment of the invention, only the basic operation of the slide door 3 has been explained. However, according to the other embodiment, it is possible to again turn the door open switch 19 ON halting the slide door 3 at that position while the slide door 3 moves along its door open direction by means of, for example, the automatic open control. Also, it is possible to turn the door close switch 20 ON changing the automatic open control to the automatic close control in order to move the slide door 3 from that place along its door close direction.

According to the previous embodiment of the invention, the manual recognition speed is judged by using the periodic count value T for continuous four periods stored in the period registers 1 to 4. However, it is possible to judge the manual recognition speed by using for example the periodic count value T for continuous two periods, in case that the vehicle parks on a slope, in order to shorten a recognition time and handle the situation in a hurry.

Effect of this Invention

According to this invention, in order to change the slide door open-close control mode from the manual to the automatic one, the drive source and the slide door open-close mechanism are connected at a half-clutched condition, then at a full-clutched condition, so that it is possible to lessen shock generated in changing the slide door open-close control mode and to obtain a smooth transferring from the manual mode to the automatic one.

Also, according to this invention, the time for detecting the manual recognition speed of the slide door is shorten, resulting in a rapid correspondence or handling of the apparatus when the vehicle parks on a slope. Also, when the vehicle stops on a slope, detection sensibility of the manual recognition speed of the slide door is adjusted. In particular, when the vehicle parks on an upward slope and the slide door is operated in its closing direction or when the vehicle parks on a downward slope and the slide door is operated in its opening direction, it is supposed that the slide door is opening or closing against its weight and the slide door open-close control mode is changed from the manual to the automatic one even the door speed is less than the manual recognition speed.

We claim:

1. A device for automatic operation of a sliding door that is also capable of manual operation in an open-close direction with respect to a vehicle body, the device comprising:

a drive source;

a sliding door open-close mechanism adapted for the automatic operation of the sliding door in the open-close direction with respect to the vehicle body;

a clutch for intermittently transferring a drive force from the drive source to the sliding door open-close mechanism;

a door speed detector adapted for measuring sliding door movement speed in the open-close direction;

a slope detector adapted for determining a direction and an amount of vehicle body pitch; and a sliding door control apparatus controlling the drive source and the clutch so as to control the drive force transferred to the sliding door open-close mechanism;

wherein the sliding door control apparatus drives the drive source when the movement speed detected by the door speed detector is faster than a predetermined manual operation speed, and the sliding door control apparatus controls the clutch so as to connect the drive source and the sliding door open-close mechanism in one of a half-clutched condition for transferring a portion of the drive force and a full-clutched condition for transferring all of the drive force; and wherein after driving the drive source, when the movement speed detected by the door speed detector is slower than the predetermined manual operation speed, the slope detector determines that the amount of pitch is greater than a predetermined value, and the sliding door control apparatus recognizes sliding door movement opposite to the direction of pitch, the sliding door control apparatus controls the clutch so as to connect the drive source and the sliding door open-close mechanism in one of a half-clutched condition for transferring a portion of the drive force and a full-clutched condition for transferring all of the drive force.

2. The device according to claim 1, wherein the portion of drive force transferred in the half-clutched condition is related to the movement speed detected by the door speed detector.

3. The device according to the claim 1, wherein the sliding door control apparatus controls the clutch so as to connect the drive source and the sliding door open-close mechanism in the half-clutched condition for a fixed time period sufficient to match the movement speed detected by the door speed detector with the driving speed of the drive source before the sliding door control apparatus controls the clutch so as to connect the drive source and the sliding door open-close mechanism in the full-clutched condition.

4. The device according to claim 3, wherein the portion of drive force transferred in the half-clutched condition is related to the movement speed detected by the door speed detector.

5. The device according to claim 1, wherein the sliding door control apparatus controls the clutch so as to connect the drive source and the sliding door open-close mechanism in the half-clutched condition until the movement speed detected by the door speed detector is slower than a predetermined speed, whereupon the sliding door control apparatus controls the clutch so as to connect the drive source and the sliding door open-close mechanism in the full-clutched condition.

6. The device according to claim 5, wherein the portion of drive force transferred in the half-clutched condition is related to the movement speed detected by the door speed detector.

7. The device according to claim 1, wherein the sliding door control apparatus gradually increases the portion of the drive force transferred to the sliding door open-close mechanism between the half-clutched condition and the full-clutched condition.

8. The device according to claim 7, wherein the portion of drive force transferred in the half-clutched condition is related to the movement speed detected by the door speed detector.

9. A device for automatic operation of a sliding door that is also capable of manual operation in an open-close direction with respect to a vehicle body, the device comprising:

a drive source;

a sliding door open-close mechanism adapted for the automatic operation of the sliding door in the open-close direction with respect to the vehicle body;

a clutch for intermittently transferring a drive force from the drive source to the sliding door open-close mechanism;

a door speed detector adapted for measuring sliding door movement speed in the open-close direction;

a slope detector adapted for determining an amount of vehicle body pitch; and a sliding door control apparatus controlling the drive source and the clutch so as to control the drive force transferred to the sliding door open-close mechanism;

wherein the sliding door control apparatus shortens a detection period of the door speed detector when the slope detector determines that the amount of pitch is greater than a predetermined value, and the sliding door control apparatus drives the drive source when the door speed detector detects in the shortened detection period that the sliding door movement speed in the open-close direction is faster than a predetermined manual operation speed, whereupon the sliding door control apparatus controls the clutch so as to connect the drive source and the sliding door open-close mechanism in a full-clutched condition for transferring all of the drive force.

* * * * *